US007011209B2

(12) United States Patent
Sutherland et al.

(10) Patent No.: US 7,011,209 B2
(45) Date of Patent: Mar. 14, 2006

(54) BOTTLE CARRIER WITH IMPROVED CARRYING HANDLE

(75) Inventors: Robert L. Sutherland, Kennesaw, GA (US); Jim Fogle, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 10/025,680

(22) Filed: Dec. 19, 2001

(65) Prior Publication Data

US 2003/0111362 A1 Jun. 19, 2003

(51) Int. Cl.
*B65D 85/62* (2006.01)

(52) U.S. Cl. ..... 206/175; 206/193; 206/427

(58) Field of Classification Search ..... 206/139, 206/142, 162, 163, 165, 166, 168, 171, 172, 206/175, 193, 194, 199, 200, 427
See application file for complete search history.

(56) References Cited

U.S. PATENT DOCUMENTS

| | | | | | |
|---|---|---|---|---|---|
| 2,563,065 | A | * | 8/1951 | Price | 206/171 |
| 3,684,153 | A | * | 8/1972 | Detzel | 206/199 |
| 4,470,503 | A | * | 9/1984 | Stone | 206/141 |
| 5,400,901 | A | * | 3/1995 | Harrelson | 206/143 |
| 5,624,024 | A | * | 4/1997 | Miess | 206/172 |

* cited by examiner

*Primary Examiner*—Jacob K. Ackun
(74) *Attorney, Agent, or Firm*—Womble Carlyle Sandridge & Rice, PLLC

(57) ABSTRACT

A wrap-around carrier for carrying bottles, which extend through apertures in the upper sidewall with the apertures being spanned by bridges. The bridges between the rows of apertures may be locked or glued. This carrier may have a handle that extends above the tops of the bottles but which can be folded down between the tops of the bottles so that the carrier can be stacked one (1) on top of the other.

11 Claims, 11 Drawing Sheets

BOTTLE CARRIER WITH IMPROVED CARRYING HANDLE

FIELD OF THE INVENTION

The present invention relates generally to a basket carrier for carrying bottles whose necks stick through apertures in upper sidewalls of the carrier with the apertures being held together by bridges. After the bottles have been loaded, the handle on the carton can be folded down between the necks of two (2) rows of bottles so that the carrier with bottles can be stacked one atop another. A store clerk or consumer can release the handle from the fold down position in order to carry the carrier. The carrier of this invention also has end webs in the handle panels that fold inwardly as the carrier is being loaded with bottles in order to increase the strength of the handle. The handle is further re-enforced by folding cut outs for the handle apertures into the handle panels to provide additional re-enforcement.

BACKGROUND OF THE INVENTION

Basket carriers for carrying a plurality of bottles are well known in the art. While these carriers typically have a stand up (vertical) handle, the handle does not extend above the tops of the bottles; thus permitting the carriers to be stacked one on top the other. Because the handle does not extend above the tops of the bottles it is not very convenient for carrying the carrier as the bottle tops get in the way of a person's hand.

It would be desirable to reduce the caliber and amount of paperboard that is used to produce a bottle carrier where the necks of the bottles extend through the upper sidewalls of the carrier (i.e., a wrap-around bottle carrier). One of the weak points of the carrier is the aperture through which a bottle extends. It would be desirable if those apertures could be re-enforced so that the caliber of the paperboard could be reduced.

Another weak point of the wrap-around carrier for bottles is the handle structure. It would be desirable if the handle structure could be re-enforced so that the handle does not give way when a person is carrying a carrier full of heavy bottles, which are loaded with a beverage.

SUMMARY OF THE INVENTION

It is the object of the this invention to design a wrap-around bottle carrier where the bottle necks stick through the top of the carrier which can use a lower caliber of paperboard than present wrap-around bottle carriers. It is the particular object of this invention to strengthen the apertures through which the necks of the bottles extend, as this is one of the weak points of wrap-around bottle carriers. It is a further object of this invention to strengthen the handle, which extends above the tops of the bottles being carried to minimize or eliminate handle failure while carrying a loaded carrier. In order to improve the stackability of loaded carriers, it would be desirable to have a handle that folds down below the tops of the bottles being carried.

The object of strengthening the apertures through which the necks of the bottles extend has been achieved by utilizing a bridge of paperboard that extends between two (2) apertures in different rows. This bridge can be built from one (1) aperture and then locked into the aperture in the adjacent row. Alternatively, a bridge can be extended from each aperture and glued together.

The object of increasing the strength of the handle which extends above the tops of the bottles has been achieved by providing a web on each end of the handle that can be folded inwardly during erection. The strength of the handle can also increased by folding the paperboard that is cut to form the aperture for the hand into the handle structure.

The carrier of this invention can be stacked by folding the handle that extends above the tops of the bottles down between the tops of the bottles. This handle can be readily extended for carrying.

The carriers of this invention are formed from a single blank of paperboard and are folded and glued together to form collapsed carrier. This carrier can be formed from a single rectangular blank of paperboard of a thin caliber, which increases efficiency and reduces waste.

These and other objects, features, and advantages of the present invention will become more apparent upon reading the following specification in conjunction with the accompanying drawings and figures.

DETAILED DESCRIPTION OF THE PREFERRED EMBODIMENTS

The present invention is intended primarily for use with wrap-around carriers containing bottles of the types to contain soft drinks, beer and the like. A typical example of such a bottle has a generally cylindrical body with an upper portion and a bottom, a tapering shoulder smoothly continuous with the portion of the body, and a neck formed on the shoulder having a smaller diameter than the body. This conventional bottle B also has a neck flange projecting outwardly from the neck, and a cap attached to the upper end of the neck flange.

The wrap-around carriers of this invention have apertures in the upper sidewalls through which the necks of the bottles extend and has a carrying handle that extends above the tops of the bottles.

Carrier with Conventional Retaining Assemblies

Figure 1:
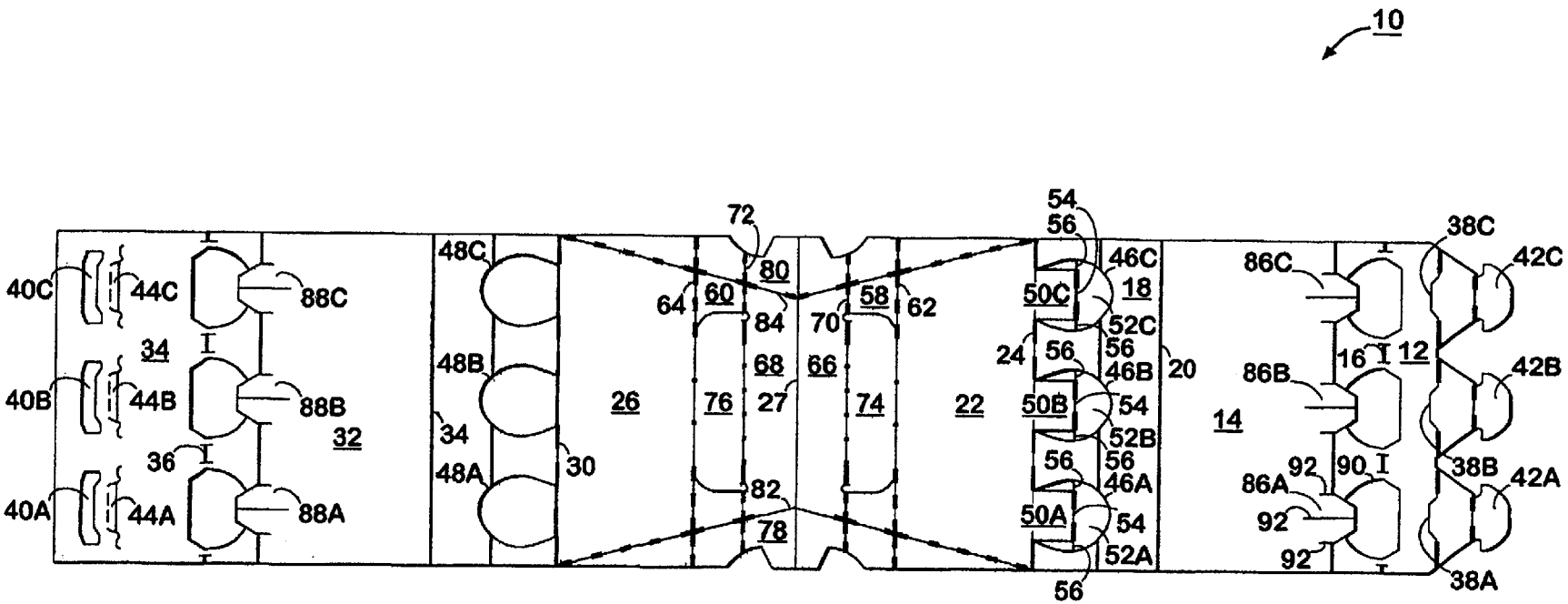
FIG. 1 is a plan view of a blank, which incorporates the carrying handle with locking tongues of the present invention.

The blank for forming the carrier of this embodiment is illustrated in FIG. 1. This blank 10 is designed to contain six beverage bottles B arranged in two rows of three each. The blank 10 is formed from a foldable sheet of material, such as paperboard. The blank has a bottom panel 12, which is foldable connected to a lower side panel 14 by fold line 16, and in turn is connected to an upper side panel 18 by fold line 20. Upper side panel 18 is connected to handle panel 22 by fold line 24, and in turn connected to handle panel 26 by fold line 27. Handle panel 26 is foldable connected to upper side panel 28 by fold line 30 and in turn connected to lower side panel 32 by fold line 34. Lower side panel 32 is foldable connected to bottom panel 35 by fold line 36.

It will be understood by those in the art that the preferable carrier is symmetrical about a horizontal line of bisection, as viewed from FIG. 1. This symmetry aids in the efficient production of the present carrier. The carrier need not have such symmetry, although it is preferred. As shown, the blank 10 is rectangular in shape and includes straight edges, which also makes for an efficient layout of the blank in a web from which the blanks are cut.

The carrier of FIG. 1 is held together by locks. The locking system used on the carrier formed from FIG. 1 includes both the primary locking system and a secondary locking system. The primary locking system is the locking arrangement between primary male locks 38A, 38B, and 38C and primary female openings 40A, 40B, and 40C. The primary male locks 38A, 38B, and 38C are hooked over the locking ledges of the primary female openings 40A, 40B and 40C. As it is important to tighten the carrier tightly about the bottles, the primary female openings 40A, 40B, and 40C also serve as tightening apertures, which allows mechanical tightening fingers to enter and tighten the carrier during forming.

The primary locks connect the ends of the carrier together via the flaps, while secondary locks function to maintain the engaged flaps in place in order to provide a "backup" locking system to prevent the primary locks from separating.

The secondary locking system consists of secondary male locks 42A, 42B, and 42C formed as an extension of bottom flap 12 and secondary female openings 44A, 44B and 44C in bottom panel 35. This is a conventional locking system, which is known in the art. While the primary locks connect the ends of the carrier together, the secondary locks keep the primary locks engaged.

The upper side panel 18 has apertures 46A, 46B, and 46C through which the necks of the bottles B extend. Upper side panel 28 similarly has apertures 48A, 48B and 48C through which the necks of the bottles B extend. Locking tongues 50A, 50B and 50C are formed in the cutting of apertures 46A, 46B and 46C respectively. Each tongue has a locking head 52A, 52B, and 52C connected by fold line 54. Locking heads 52A, 52B, and 52C have locking edges 56, whose function will be described later.

The handle panels 22 and 26 have aperture panels 58 and 60 which are formed as a part of the handle panels that are connected thereto by fold lines 62 and 64 respectively which are in turn connected to holding panels 66 and 68 by fold lines 70 and 72 respectively. Holding panels 66 and 68 are inter-connected by fold line 27. Aperture flaps 74 and 76 are connected to holding panels 66 and 68 respectively by fold lines 70 and 72. These aperture flaps 74 and 76 can be folded about their fold lines and placed in juxtaposition to holding panels 66 and 68 respectively to strengthen the carrying capacity of the carrier. The handle panels 22 and 26 have a web 78 and 80 on each side of the handle panel, which is connected to the handle panels by fold lines 82 and 84. These webs 78 and 80 can be folded inwardly in the process of erecting the carrier to strengthen the handle.

The heels of the bottles B may be restrained from movement by the provision of heel retaining assemblies 86A, 86B, 86C, 88A, 88B and 88C or other suitable means for restraining the heels of the bottles from movement within the carrier. These heel retaining assemblies also permit the carrier to be tightly locked in that a portion of heel of the bottle can extend through the heel retaining assembly. These heel retaining assemblies are all identical. For example, heel retaining assembly 86A has an aperture 90 and multiple slits 92 to facilitate the entry of the heel of the bottle into the aperture 90. This reduces the stress of the paperboard around the heel of the bottle.

The carrier of this embodiment is formed from the blank of FIG. 1 by moving the upper side panels 18 and 28 so that a portion of the necks of a group of bottles B extend through the apertures 46A–C and 48A–C. Locking tongues 50A, 50B and 50C are inserted through apertures 48A, 48B and 48C respectively. These locking tongues are held in position by locking edges 56 on locked heads 52A, 52B, and 52C. The locking edges 56 engage with the sides of apertures 48A, 48B, 46C. These apertures are oval in construction so that the oval portion near fold line 30 is truncated so that the distance between the edges of an aperture along fold line 30 is narrower than the widest portion of the locking heads 52A and 52C along fold line 54. The locking heads are pushed upwardly in juxtaposition to the outside surface of handle panel 26 and held in position by the necks of the bottles. This secures the handle panels 22 and 26 together and strengthens the entire handle structure. In the process of erecting this carrier, the aperture flaps 74 and 76 are folded around fold lines 70 and 72 until they are flat against holding panels 66 and 68 respectively. The aperture flaps may be glued for additional strength. Web panels 78 and 80 are then folded inwardly until they are flat against handle panels 22 and 26.

The blank is pulled tight about the bottles B and the bottom panels 12 and 35 are overlapped and locked in the conventional fashion. Bottom panel 12 is on the outside of bottom panel 35. The primary male locks 38A–C are punched inwardly into primary female opening 40A–C and are locked on the primary female ledges. The secondary male locks 42A–C are pushed inwardly into the secondary female opening 44A–C.

Figure 2:
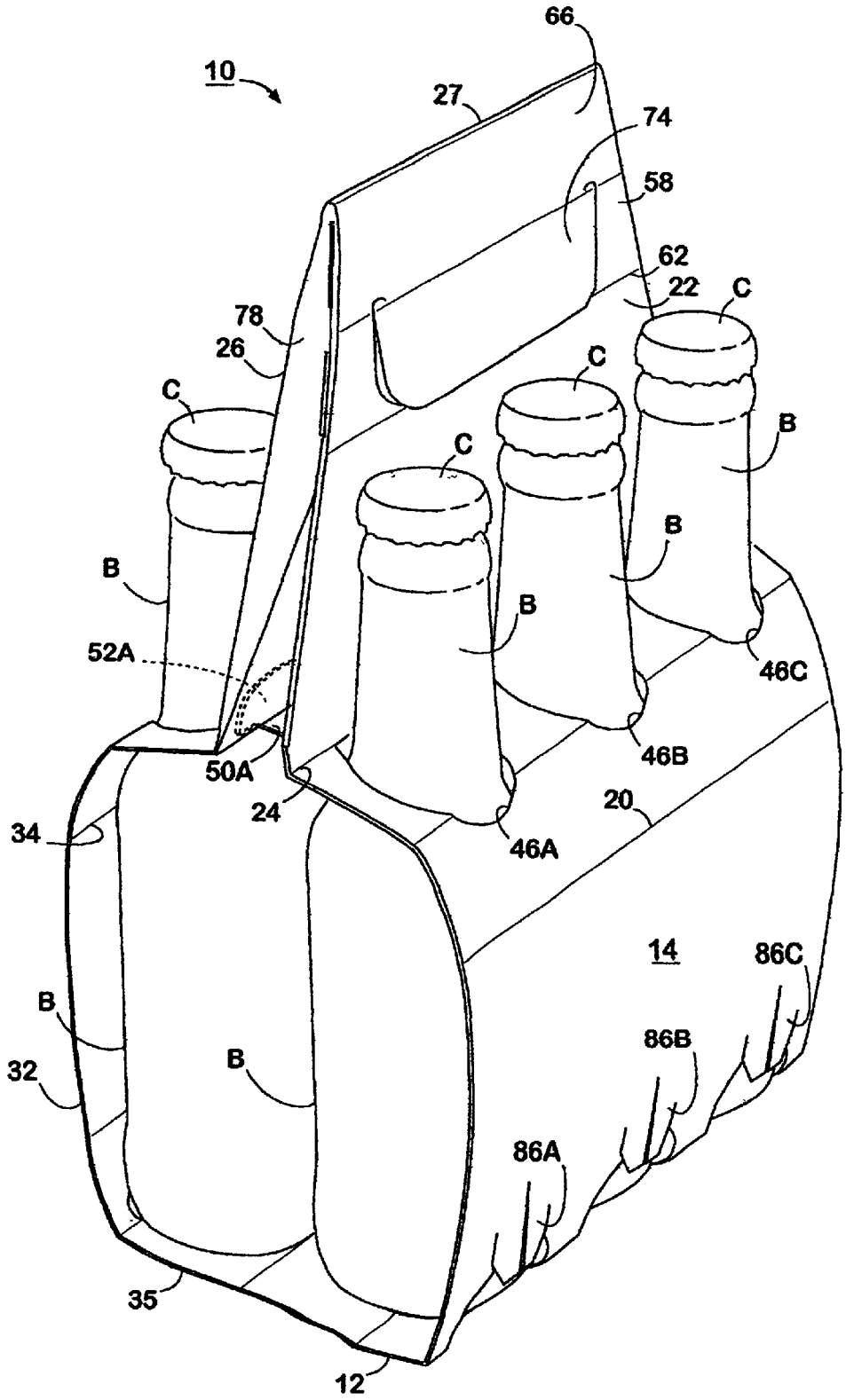
FIG. 2 is a perspective view of the blank of FIG. 1, which has been erected and loaded with bottles.

FIG. 2 is a view of the blank of FIG. 1, which has been erected and loaded with bottles as described above. It will be seen that holding panel 66 and aperture flap 74 extend above the tops of the bottles B for ease in carrying.

Figure 3:
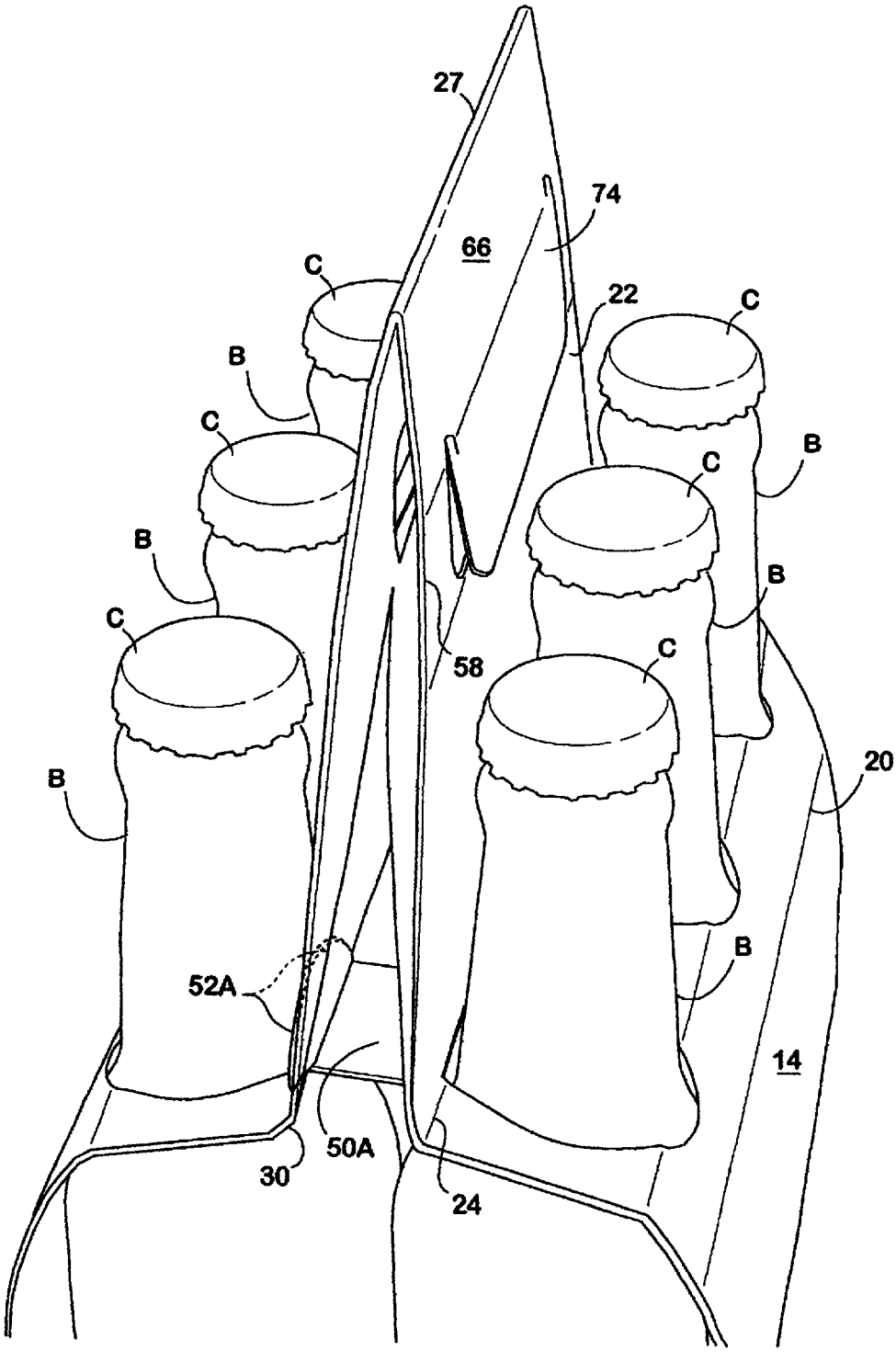
FIG. 3 is an end view of the carrier of FIG. 2, which shows the details of the tongue holding the handle together.

FIG. 3 is a close up view of the end the carrier of FIG. 2, which shows the details of the tongue holding the handle together. Locking tongue 50A and locking head 52A are held in position by the neck of the bottle B is illustrated. This secures the handle panels from separating during carrying of the carrier with loaded bottles.

Figure 4:
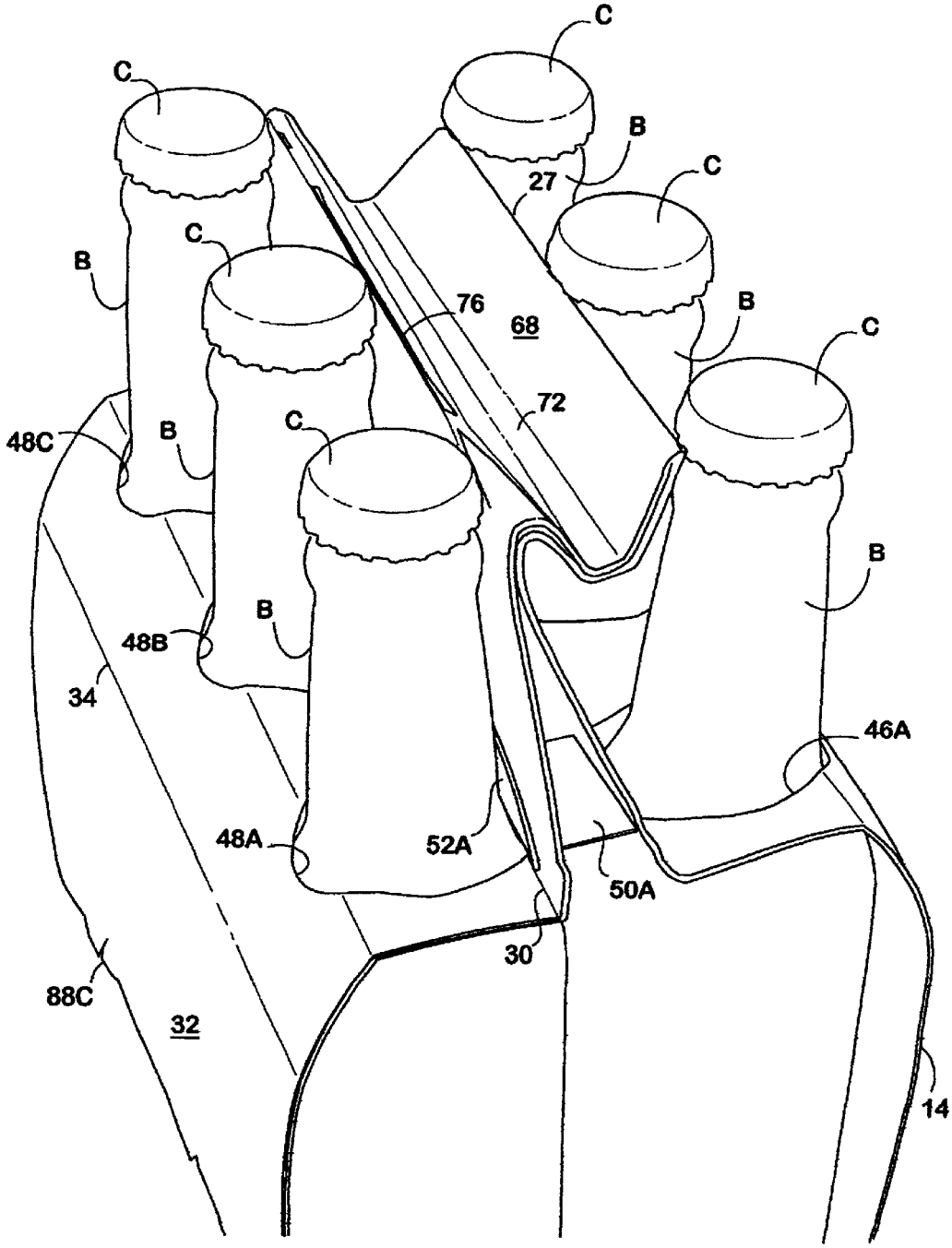
FIG. 4 is an end perspective view of the carrier of FIG. 2, which shows the handle in the folded down position.

FIG. 4 is an end perspective view of the top of the carrier of FIG. 2, which shows the handle in the folded down position. Aperture panels 58 and 60 and holding panels 66 and 68 are folded down below the tops of the bottles by the packaging machine that loads the carrier with bottles. The handle can be easily opened by store clerks or by the consumer for carrying.

Carrier with Hinged Heel Aperture Doors

Figure 5:
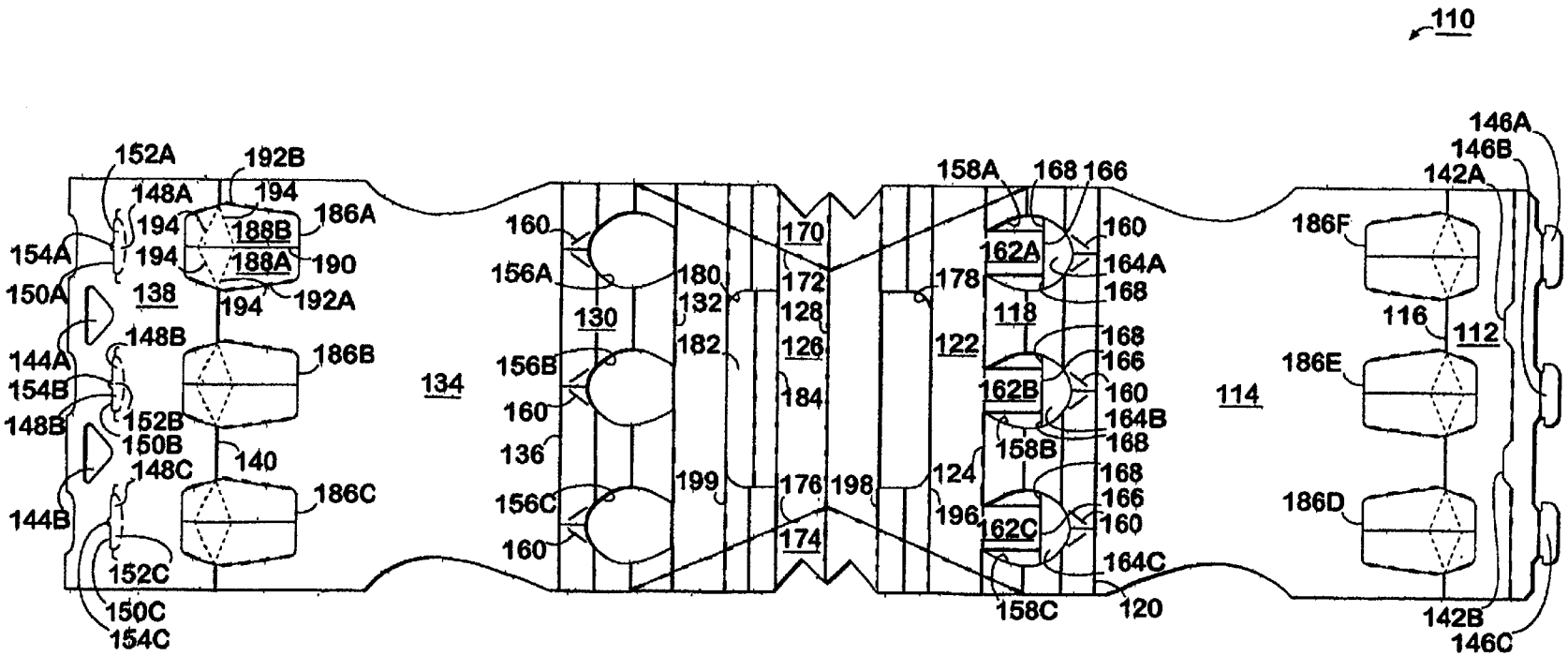
FIG. 5 is a plan view of the blank, which incorporates a carrying handle with locking tongues of the present invention and has hinged heel aperture doors.

This carrier is similar to the carrier illustrated in FIG. 1 except for the provision of hinged heel aperture doors. The blank for forming the carrier of this embodiment is illustrated in FIG. 5. This blank 110 is designed to contain six (6) beverage bottles B arranged in two (2) rows of three (3)

each. The blank 110 is formed from a foldable sheet of material, such as paperboard. The blank has a bottom panel 112, which is foldably connected to a lower side panel 114 by fold line 116, and in turn connected to an upper side panel 118 by fold line 120 and in turn connected to handle panel 122 by fold line 124. Handle panel 122 is connected to handle panel 126 by fold line 128, and in turn connected to upper side panel 130 by fold line 132 and in turn connected to lower side panel 134 by fold line 136 which in turn is connected to bottom panel 138 by fold line 140.

As in the case of the carrier illustrated in FIG. 1, this carrier includes both the primary locking system and a secondary locking system. The primary locking system is the locking arrangement between the primary male locks 142A and 142B in bottom panel 112, which is the primary lock panel in this carrier, and primary female openings 144A and 144B in bottom panel 138. The primary female openings 144A and 144B serve as tightening apertures, which allow mechanical tightening fingers to enter and tighten the carrier during forming.

The primary locks connect the ends of the carrier together via the flaps, while secondary locks function to maintain the engaged flaps in place in order to provide a "backup" locking system to prevent the primary locks from separating.

The secondary locking system consists of secondary male locks 146A–C formed as an extension of bottom flap 112 and secondary female opening 148A–C. The secondary female openings are formed by cut lines 150A–C producing female flap 152A–C. These flaps may have arcuate tabs 154A–C, whose function will be described infra.

This invention provides a locking system that is very secure. While the primary locks connect the ends of the carrier together, the secondary locks keep the primary locks engaged. The secondary locks are secured in that the secondary male locks 146A–C are held in the vertical position in respect to the carrier by the secondary female flaps 152A–C and the arcuate tabs 154A–C on the ends of the lock of the flap. If the secondary male locks 146A–C were allowed to be parallel to the bottom panels 112 and 138, they could easily become disengaged.

The upper side panel 130 has apertures 156A–C through which the necks of the bottles B extend. Similarly, upper side panel 118 has apertures 158A–C through which the necks of the bottles may extend. These apertures 156A–C and 158A–C may have slits 160 to accommodate bottle necks with variations in diameter. In the process of cutting apertures 158A–C, tongues 162A–C can be left which are attached to handle panel 122 by fold line 124. These tongues may have locking heads 164A–C attached to the locking tongues 162A–C by fold lines 166. These locking heads 164A–C may have locking edges 168. The apertures 156A–C may be constructed so that they are oval in form with the portion of the oval truncated at the fold line 132 to the handle panel 122. This will facilitate the locking edges 168 of the locking heads 164A–C being held in a locked position by the edges of apertures 156A–C. The locking heads 164A–C are bent upwardly in the carrier when the bottles necks are extended through apertures 156A–C. To further strengthen the handle webs 170 and 174 are attached to the ends of handle panels 122 and 126 by fold lines 172 and 176. Apertures 178 and 180 for carrying are formed in handle panels 122 and 126. To further reinforce the handle aperture one or both of the apertures can retain a reinforced flap partially cut from the aperture as illustrated by 182 in aperture 180 which is connected to handle panel 126 by fold line 184.

The heels of bottles B may be restrained from the movement by the provision of heel retaining assemblies 186A–F, or other suitable means for retaining the heels of the bottles from movement within the carrier. These heel retaining assemblies also permit the carrier to be tightly locked in that a portion of the heel of the bottle B can extend through the heel retaining assembly 186A–F. These heel retaining assemblies are all identical. Only heel retaining assembly 186A will be explained in detail. Heel doors 188A and 188B are provided in heel assembly 186A in the lower side panel 134 and into the bottom panel 138 through fold line 140. These doors 188A and 188B open inwardly during the erection of the carrier from the cut line 190 between a set of heel doors. These doors are hinged to the panels by fold lines 192A and 192B. These fold lines 192A and 192B permit the heel door 188A and 188B of the carrier to be swung inwardly during erection. This permits each bottle B to be nested between a set of adjacent heel doors 188A and 188B of the heel retaining assembly 186A. This facilitates holding each bottle B in proper position. More importantly, these doors tend to restrain tearing around the heel apertures that are formed by these doors. Without these door 188A and 188B, there would only be cuts that could easily be torn. Further, these doors 188A and 188B provide a flexible buffer against which the heel of the bottle can abut without tearing the carrier panel surrounding the heel-retaining aperture.

Cut lines 194 may be formed in each set of doors to reduce the stress on the paperboard around the heel of the bottle. The door openings allow a relative large portion of the heel of the bottle to be inserted into the aperture formed by the doors' opening, thereby enabling a relative strong pack to tighten while minimizing the risk of tearing.

The carrier of this invention is formed from the blank of FIG. 5 by moving the upper side panels 118 and 130 of the blank so that a portion of the necks of a group of bottles B extend up through the apertures 156A–C and 158A–C.

In the process of erecting this carrier, flap 182 in aperture 180 is folded over against handle panel 126 and held in juxtaposition to this panel to reinforce the carrier handle. This flap 182 may be glued to handle panel 126 if desired. Webs 170 and 174 are folded inwardly to reinforce the handle of the carrier. Before inserting the bottles in the apertures 158A–C and 156A–C, the locking tongues 162A–C and locking heads 164A–C are bent and inserted into apertures 156A–C. The locking heads 164A–C are pushed into an upright position and are held in that position by the necks of the bottles when the bottles are inserted through the apertures 156A–C. These locking heads 164A–C and locking tongues 162A–C further strengthen the handle of this carrier.

The blank 110 is pulled tight about the bottles B and she bottom panels 112 and 138 are overlapped with bottom panel 112 being on the outside. The primary male locks 142A and 142B are punched inward into primary female opening 144A and 144B and are locked on the ledges of these openings. The secondary male locks 146A–C are pushed inwardly into the aperture formed when secondary female opening 148A–C are pushed inwardly into the aperture formed when female flaps 152A–C are pushed inwardly by secondary male locks 146A–C.

Secondary male locks 146A–C are held in a vertical position by secondary female flaps 152A–C. The arcuate tabs 154A–C on each secondary female flaps 152A–C lean against the secondary male lock 146A–C and assists in holding the secondary male lock 146A–C in the vertical position. Holding the secondary male locks 146A–C in the vertical position ensures that the locks are not accidentally withdrawn. The secondary lock system serves the function of ensuring that the primary lock does not become undone. The holding of the secondary male locks 146A–C by the secondary female flap 152A–C and arcuate tab 154A–C prevents the accidental unlocking of these locks.

Figure 6:
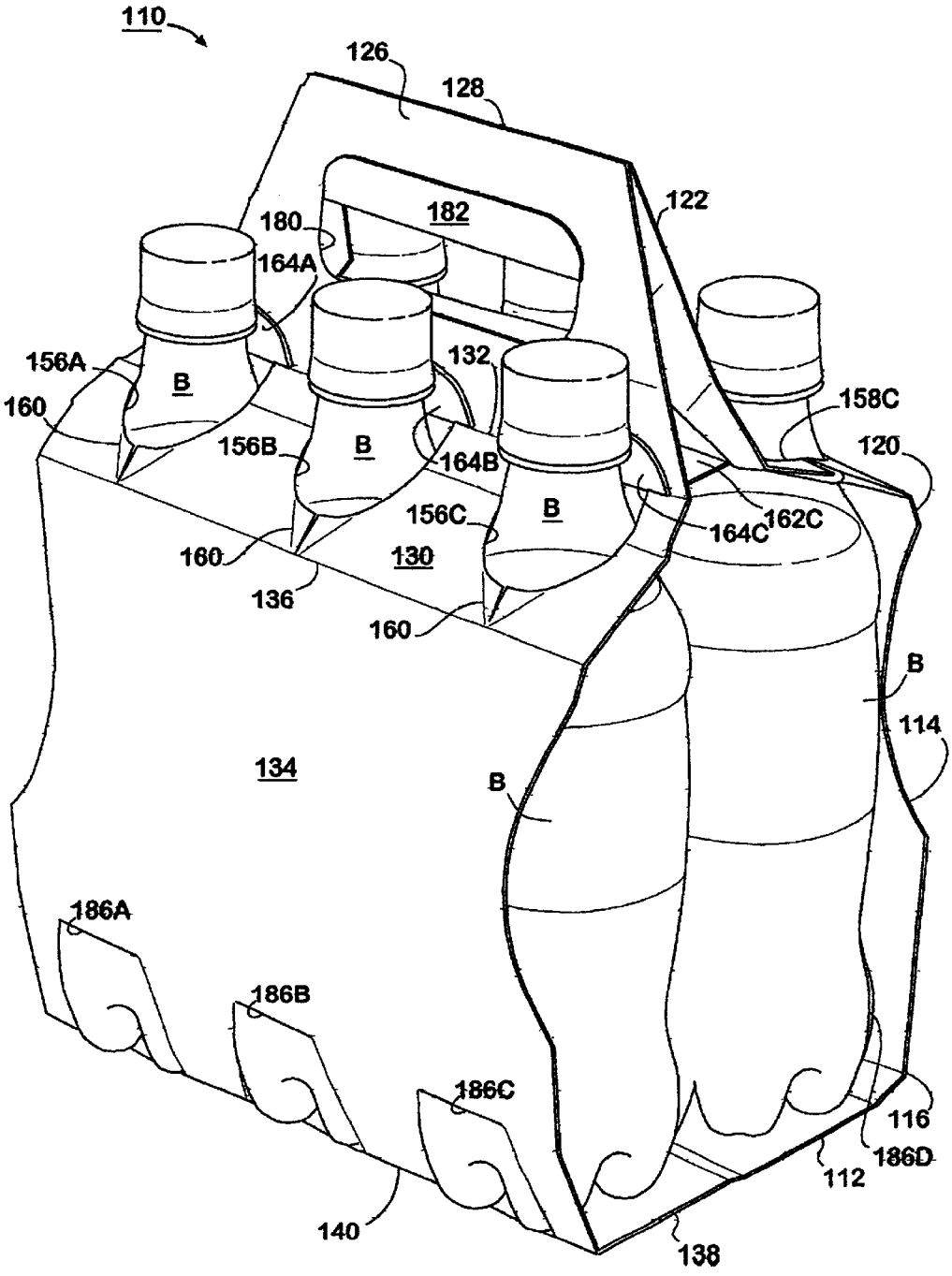
FIG. 6 is a perspective view of the blank of FIG. 5, which has been erected and loaded with bottles.

This carrier when fully loaded with bottles is shown in FIG. 6.

As with the carrier shown in FIG. 1, the handle panels 122 and 126 can be folded down along fold lines 196, 124, 198, 128 and 199 along the necks of the bottles B so that the carrier with bottles can be stacked. This is similar to the way in which the carrier FIG. 1 is stacked as shown in FIG. 4. It is preferable that the handle panels 122 and 126 be folded in the same direction from which the locking tongues 162A–C and locking heads 164A–C are extended. Fold line 128 can rest against the caps C of the bottles as shown in FIG. 4. in respect to the carrier formed from FIG. 1.

Bottle Carrier with Glued Bridges

Figure 7:
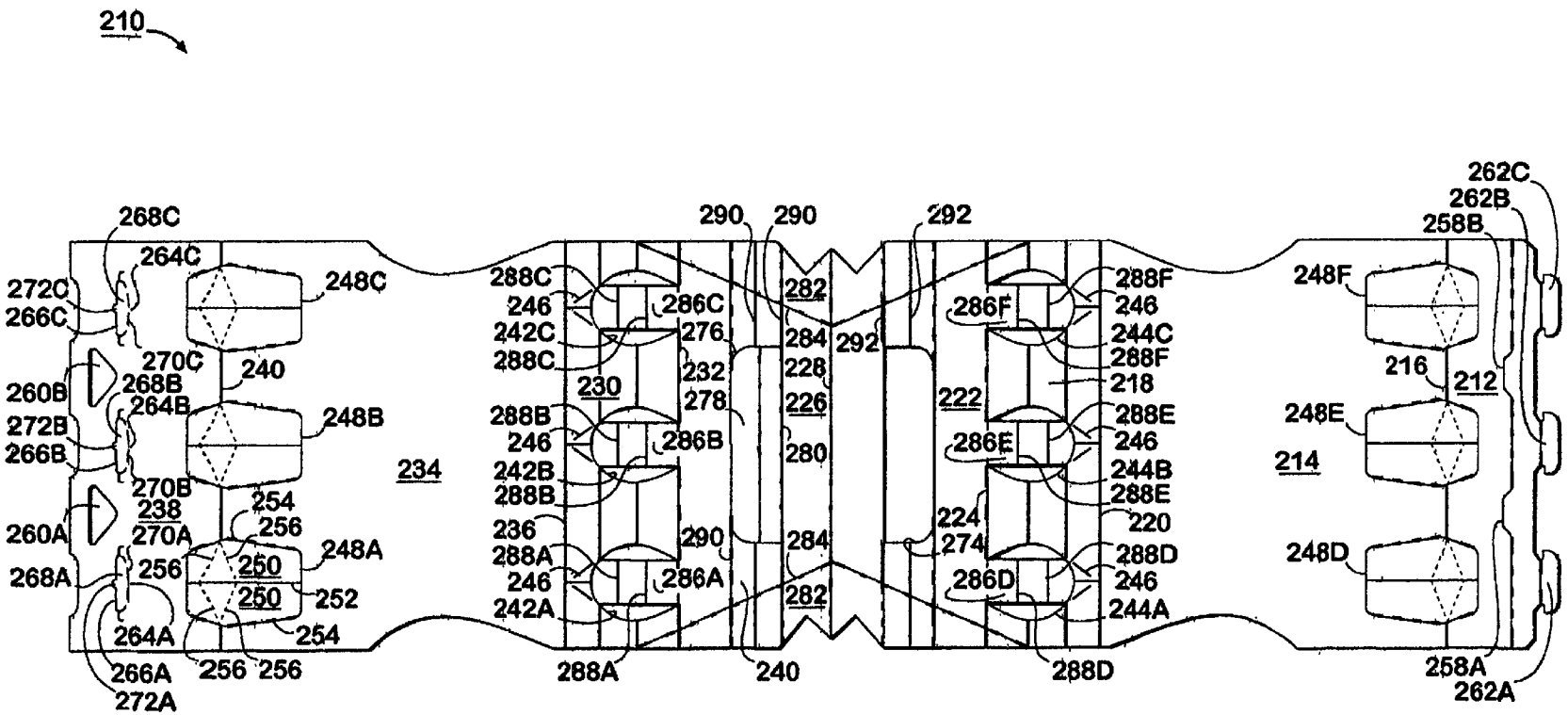
FIG. 7 is a plan view of a blank, which incorporates a carrying handle with glued bridges of the present invention.

The blank for forming a carrier with glued bridges is illustrated in FIG. 7. This blank 210 is designed to contain six (6) beverage bottles B arranged in two (2) rows of three (3) bottles each. The blank 210 is formed from a foldable sheet of material, such as paperboard. This blank has a bottom panel 212, which is foldably connected to a lower side panel 214 by fold line 216 and in turn connected to an upper side panel 218 by fold line 220. Upper side panel 218 is connected to handle panel 222 by fold line 224 and in turn is connected to handle panel 226 by fold line 228. Handle panel 226 is connected to upper side panel 230 by fold line 232. Upper side panel 230 is connected to lower side panel 234 by fold line 236. Lower side panel 234 is connected to bottom panel 238 by fold line 240. The upper side panels 230 and 218 have apertures 242A–C and 244A–C. Because the bottle necks may have variations in diameter, slits 246 may be provided to accommodate bottles with slightly greater diameters.

The heels of the bottles B may be restrained from movement by the provision of heel retaining assemblies 248A–F, or other suitable means for retaining the heels of the bottles from movement within the carrier. These heel retaining assemblies also permit the carrier to be tightly locked in that a portion of the heel bottle B can be extend through the heel retaining assembly 248A–F. These heel retaining assemblies are all identical. Only heel assembly 248A will be explained in detail. Heel doors 250 are provided in the bottom in the lower side panel 234 and extend into bottom panel 238 through fold line 240. These door open inwardly during the erection of the carrier from a cut line 252 between each set of heel doors 250. These doors are hinged to the panels by fold lines 254. These fold lines 254 permit the heel doors 250 of the carrier to be swung inwardly during the erection. This permits each bottle B to be nested between a set of adjacent heel doors 250 of the heel retaining assembly 248A. This facilitates holding each bottle B in proper position. More importantly, these doors tend to restrain tearing around the heel apertures that are formed by these doors. Without these heel doors 250, there would be, only be cuts that could be easily being torn. Further, these heel doors provide a flexible buffer against which the heel of the bottle can abut without tearing the carrier panel surrounding the heel retaining aperture.

Cut lines 256 as shown in heel retaining assembly 248A may be formed in each set of doors to reduce the stress on the paperboard around the heel of the bottle. The door opening allows a relative large portion of the heel of the bottle to be inserted into the aperture formed by the doors' opening, thereby enabling a relative strong pack to tighten while minimizing the risk of tearing.

The locking system of the present invention includes both a primary locking system and a secondary locking system. The primary locking system is the locking arrangement between primary male locks 258A–B in bottom panel 212, which is the primary lock panel and primary female openings 260A–B in bottom panel 238. Primary male locks 258A–B are hooked over the ledges of primary female openings 260A–B in locking of the carrier. As it is important to tighten the carrier tightly about the bottles, primary female openings 260A–B also serve as tightening apertures, which allows mechanical tightening fingers to enter and tighten the carrier during forming. The primary locks connect the ends of the carrier together via the flaps, while secondary locks function to maintain the engaged flaps in place in order to provide a "backup" locking system to prevent the primary locks from separating. The secondary locks consist of secondary male locks 262A–C formed as an extension of bottom panel 212 and secondary female opening 264A–C formed in bottom flap 238. Secondary female openings are formed by cut line 266A–C producing female flaps 268A–C. These flaps can be folded around fold lines 270A–C. These flaps may have arcuate tabs 272A–C, whose function will be described infra.

This invention provides a locking system that is very secure. While the primary locks connect the ends of the carrier together, the secondary locks keep the primary locks engaged. The secondary locks are secured in that the secondary male locks 262A–C are held in vertical position in respect to the carrier by the secondary female opening 264A–C and the arcuate tabs 272A–C on the ends of the lock of the flaps. If the secondary male lock 262A–C were allowed to be parallel to the bottom panels 212 and 238, they could easily become disengaged.

This carrier has handle apertures 274 and 276 formed in handle panels 222 and 226. One or both of these handle apertures may have a flap 278 connected to the handle panel by fold line 280.

Webs 282 may be attached to the handle panels 222 and 226 by fold lines 284 for further reinforcement of the handle.

This handle is further reinforced by the provision of the locking bridges 286A–F. These bridges are formed when the apertures 242A–C and 244A–C are formed. These apertures 242A–C and 244A–C are oval and truncated near the fold lines 224 and 232. These bridges 286A–F may have one of more fold lines 288A–F to facilitate erection of the carrier.

The carrier of this embodiment is formed from the blank of FIG. 7 by moving the upper side panel 218 and 230 together and gluing the respective bridges 286A–F together. The handle panels 222 and 226 and the upper side panels 218 and 230 are moved so that a portion of the necks of the bottles B extend up through the apertures 242A–C and 244A–C. Flap 278 is folded along fold line 280 to be in juxtaposition to handle panel 226. It may be glued to the handle panel 226 to increase the strength of the carrier but such gluing is not essential. Webs 282 are folded along fold lines 284 to further reinforce the handle panels 226 and 222.

The blank 210 is pulled tight about the bottles B and the bottom flaps 212 and 238 are overlapped by bottom flap 212 being on the outside. The primary male locks 258A–B are punched into primary female openings 260A–B, and are locked on the ledges of primary female openings 260A–B.

The secondary male locks 262A–C are pushed inwardly into the aperture formed when secondary female opening

264A–C is pushed inwardly by secondary male locks 262A–C. Cut lines 266A–C facilitate the insertion of the secondary male lock 262A–C into secondary female opening 264A–C.

Secondary male locks 262A–C are held in a vertical position by secondary female flaps 268A–C. The arcuate tab 272A–C on each secondary female flap 268A–C leans against the secondary male lock 262A–C and assists in holding the secondary male lock 262A–C in the vertical position. Holding the secondary male lock 262A–C in the vertical position ensures that the locks are not accidentally withdrawn. The secondary lock system serves the function of ensuring that the primary lock system does not become undone. The holding of the secondary male locks 262A–C by the secondary female flaps 268A–C and arcuate tabs 272A–C insures the integrity of the carrier.

Additional fold lines 290 and 292 in the handle panels 222 and 226 facilitate folding the handle to permit stacking these carriers one on top of the other as with other carriers that has been described supra. The handle panels 222 and 226 may be folded in either direction as the bridges 286A–F are glued together.

Figure 8:
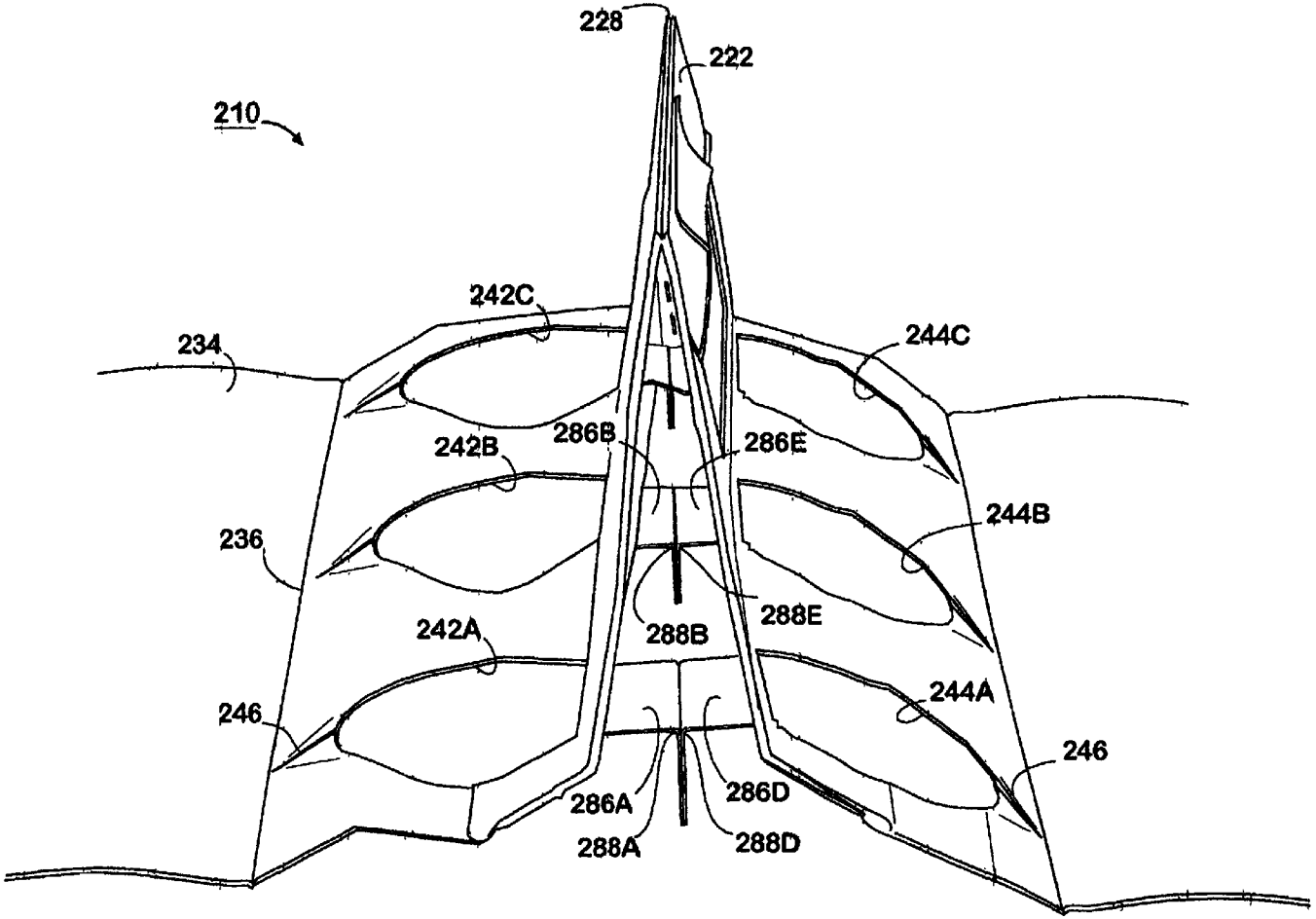
FIG. 8 is a perspective view of the blank of FIG. 7, which has been erected and loaded with bottles.

FIG. 8 shows the bridges 286A, 288A and 288D folded so that a portion of the bridge extends down along and in between the sides of the bottles.

Figure 9:
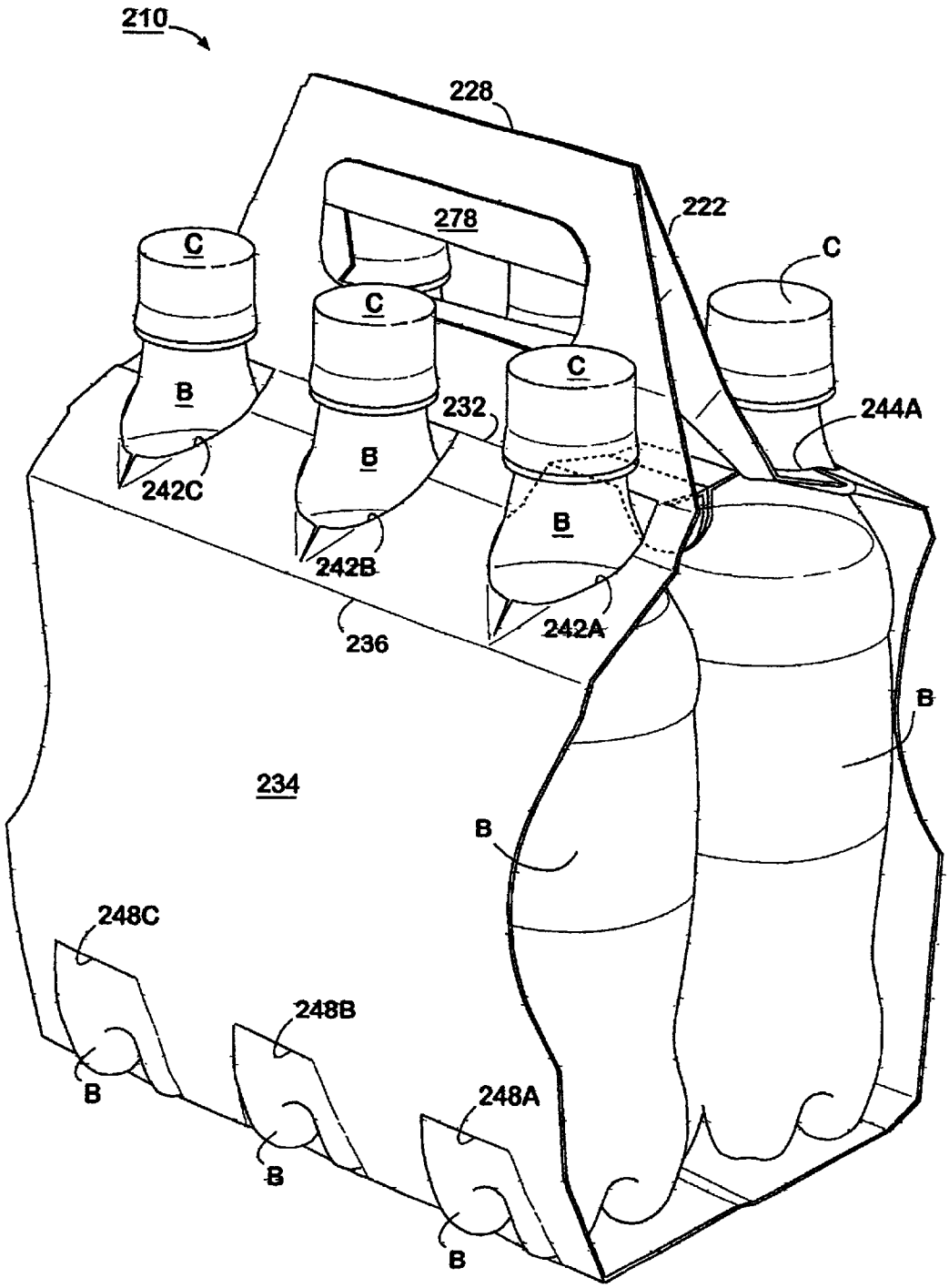
FIG. 9 is an end view of the carrier of FIG. 8, which shows the details of the glued bridges holding the handle together.

FIG. 9 shows the carton of FIG. 7 loaded with bottles.

A Further Embodiment

Figure 10:
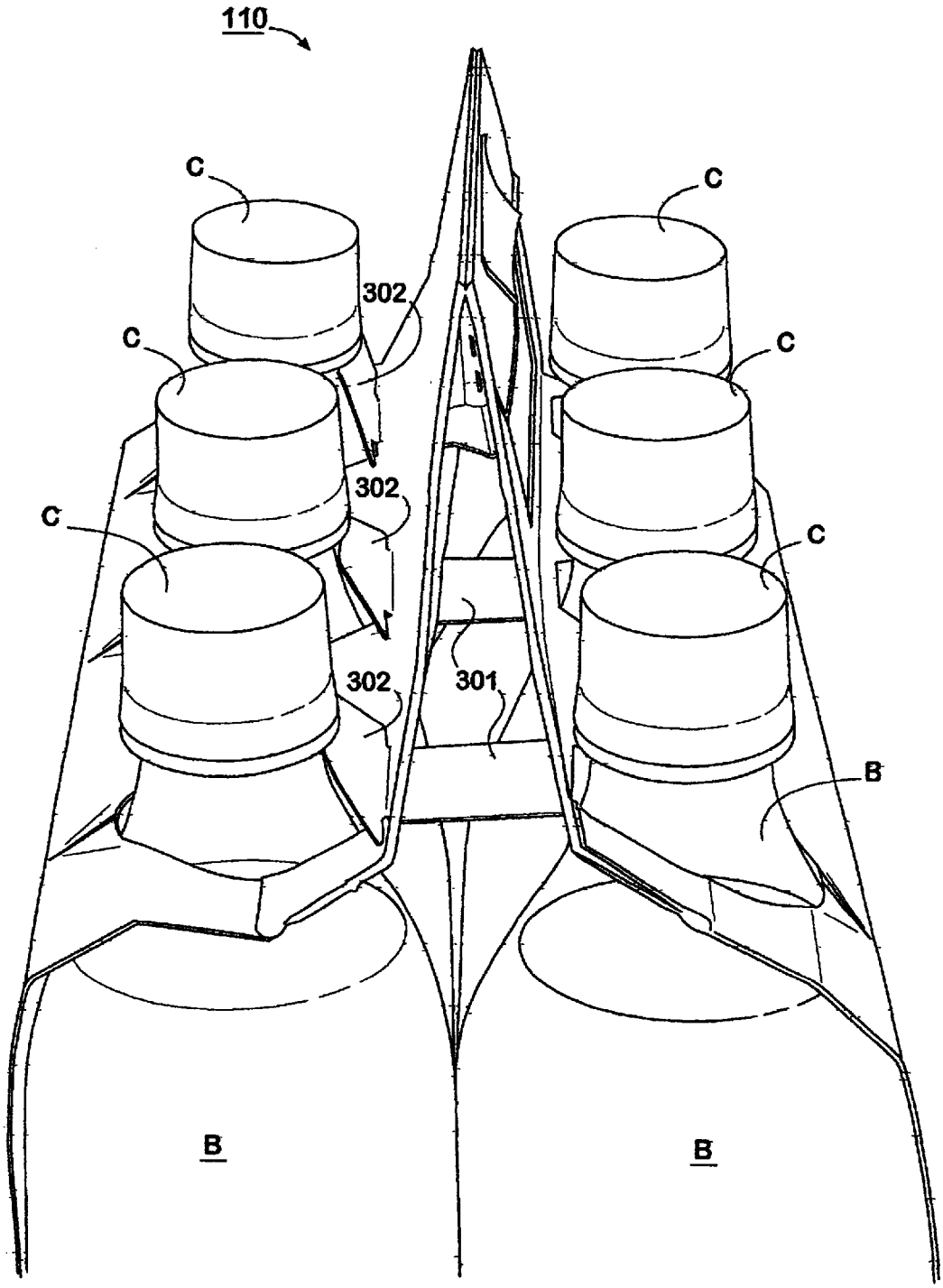
FIG. 10 is a perspective view of erected carton loaded with bottles, which shows the locking tongue of the present invention and held in the locked position by the neck of the bottle.

Another embodiment of the invention is illustrated in FIG. 10, which is the end view of a carrier with short plastic bottles B. The aperture locking invention is shown in detail with the tongue 301 foldably attached to a locking head 302, which is folded upwardly along the side of the bottle, which extends under the caps C of the bottle to assist in lifting the carrier.

Figure 11:
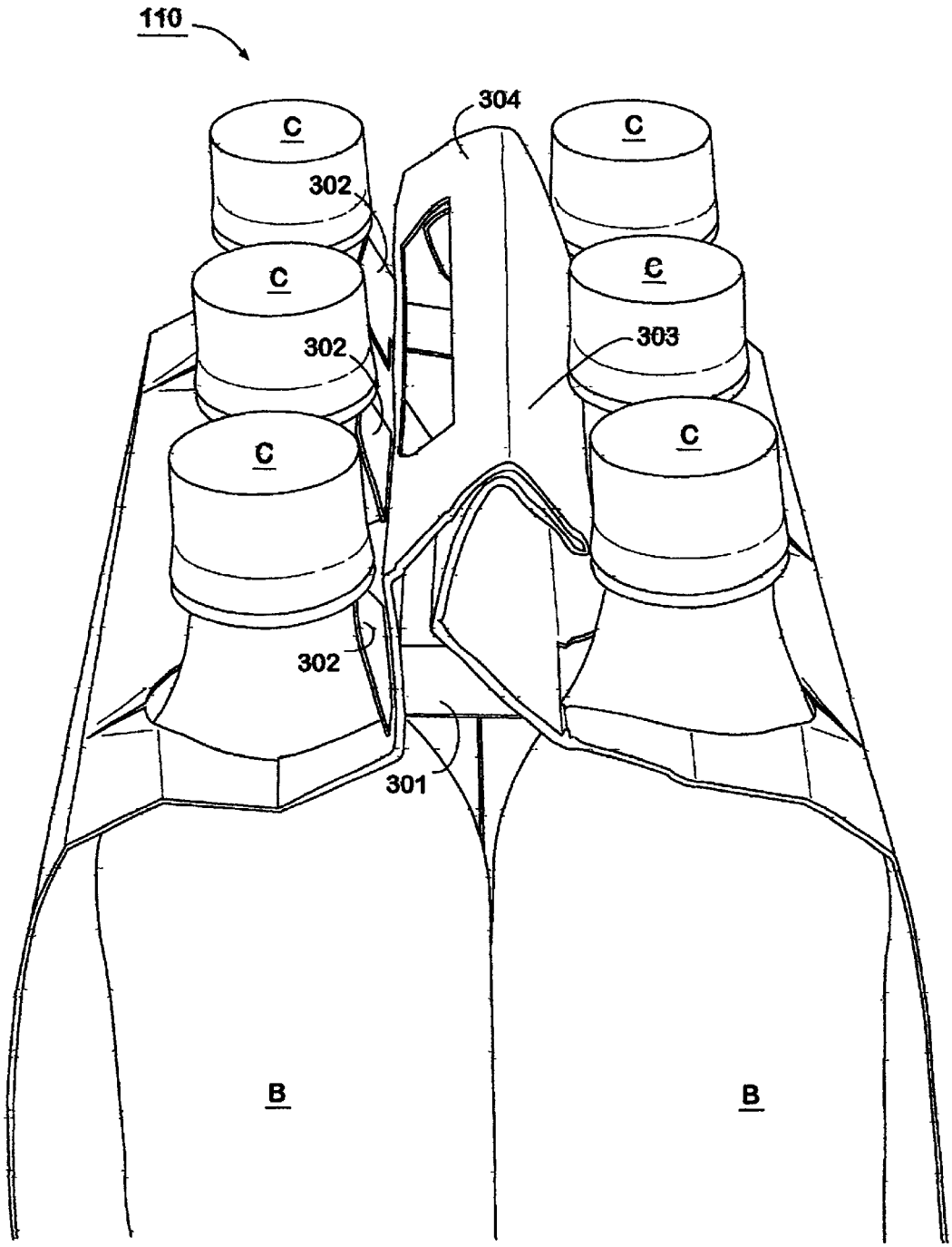
FIG. 11 is a perspective view of a carton loaded with bottles of this invention in which the handle has been folded in the fold down position.

FIG. 11 is a top end view of the carrier of FIG. 1 with the handle folded downward. Handle panel 303 is folded downwardly under the caps of the bottles and the aperture panel 304 is folded so that this carrier filled with bottles can be stacked.

While the invention has been disclosed in its preferred forms, it will be apparent to those skilled in the art that many modifications, additions, and deletions can be made therein without departing from the spirit and scope of the invention and its equivalents as set forth in the following claims.

Unique Features of this Invention

This invention provides a very strong handle utilizing a minimal amount of paperboard of thin caliber. This is permitted by the use of a bridge between the bottle apertures in the top of the carrier and the folding of end webs in the handle structure. The bridge may either be locked or glued to provide sufficient strength. Carrying tests demonstrate that these carriers will support and hold when carrying heavy glass bottles being carried. The folding over of the flaps in the handle apertures also increases the strength of the carrier.

We claim:

1. A wrap-around carrier for containing and carrying a plurality of bottles in two (2) rows comprising:

a) A bottom with sides, with a lower side panel attached to each side of the bottom, each lower side panel having an upper side which is attached to an upper side panel, each of which has an upper side which is attached to a carrying handle located between the upper side panels, said handle being designed to extend above the tops of the bottles being carried; and b) Each upper side panel having a row of apertures through which the necks of the bottles are designed to extend, each aperture in each row having a edge in the upper side panel to which a bridge is attached to an aperture edge in the row in the other upper side panel to assist in holding the upper side panels of the carrier together, each bridge having a locking head which locks with an aperture edge in the other row of apertures.

2. The carrier of claim 1 in which the locking head of each bridge is folded upwardly so it is lodged between the handle and the neck of the bottle when loaded.

3. The carrier in claim 2 in which the locking head has an end, which can be lodged against the bottom of the bottle cap to aid in supporting the carrier when carried.

4. The carrier of claim 1 in which the carrier handle has two (2) ends to which is foldably attached a web, which is folded inwardly during the erection of the carrier to assist in strengthening the handle.

5. The carrier of claim 4 which has an aperture in the handle for inserting the hand to carry the carrier with the flap for forming the aperture being only partially severed so that the flap can be folded against the handle to strengthen the handle.

6. The carrier of claim 1 in which each bridge is foldably attached to an aperture edge and glued to a bridge attached to the edge of the aperture in the other row.

7. The carrier of claim 6 in which the carrier handle has two (2) ends to which is foldably attached to a web, which is folded inwardly during the erection of the carrier to assist in strengthening the handle.

8. The carrier of claim 7 which has an aperture in the handle for inserting the hand to carry the carrier, with a flap for forming the aperture being only partially severed so that the flap can be folded against the handle to strengthen the handle.

9. The carrier in claim 1 in which the bottom comprises two (2) panels which are held together by locks.

10. The wrap-around carrier of claim 1 in which the carrying handle is foldable downwardly between the two (2) rows of bottles so one (1) carrier with bottles can be stacked on top of another carrier with bottles.

11. The carrier of claim 6 in which the carrying handle is foldable downwardly between the two (2) rows of bottles so one (1) carrier with bottles can be stacked on top of another carrier with bottles.

* * * * *